US005467581A

United States Patent [19]

Everette

[11] Patent Number: 5,467,581

[45] Date of Patent: Nov. 21, 1995

[54] APPARATUS AND PROCESS FOR POSITIONING A FITMENT

[75] Inventor: David B. Everette, Greenville, S.C.

[73] Assignee: W. R. Grace & Co.-Conn., Duncan, S.C.

[21] Appl. No.: 232,561

[22] Filed: Apr. 25, 1994

[51] Int. Cl.[6] ..... B65B 61/18

[52] U.S. Cl. ..... 53/133.2; 53/450; 53/550; 53/133.1

[58] Field of Search ..... 53/133.1, 133.2, 53/550, 551, 450, 451, 412, 314; 493/213, 929; 156/552, 558, 514; 193/44

[56] References Cited

U.S. PATENT DOCUMENTS

| | | | |
|---|---|---|---|
| 2,647,672 | 8/1953 | Burnell | 53/314 |
| 3,342,305 | 1/1966 | Ocho | 193/44 |
| 3,894,381 | 7/1975 | Christine et al. | 53/133.2 |
| 4,506,494 | 3/1985 | Shimoyama et al. | 53/551 |
| 4,533,425 | 8/1985 | Wehle | 53/133.2 |
| 4,603,793 | 8/1986 | Stern | 222/105 |
| 4,718,215 | 1/1988 | Carveth et al. | 53/133.2 |
| 4,779,397 | 10/1988 | Christine et al. | 53/133.2 |
| 5,267,934 | 12/1993 | Pape et al. | 53/133.2 |

*Primary Examiner*—John Sipos
*Assistant Examiner*—Gene Kim
*Attorney, Agent, or Firm*—Mark B. Quatt

[57] ABSTRACT

An apparatus for positioning and attaching a plurality of fitments to a film comprises a means for guiding a plurality of fitments; a means for attaching the fitments to the film; and a means for indexing the fitments, the means for indexing comprising a plurality of projecting fingers thereon, the projecting fingers being spaced apart from each other at respective outer ends of each finger, such that when a first fitment has been attached to the film and advances past the means for indexing, the means for indexing rotates, and a second fitment is advanced into attaching position. The invention is also a process for positioning and attaching a plurality of fitments to a film comprises engaging a first fitment with a means for indexing having a plurality of projecting fingers thereon, the projecting fingers being spaced apart from each other at respective outer ends of each finger; attaching the first fitment to the film; and advancing the film, with the first fitment attached thereto, such that the first fitment advances past the means for indexing, the means for indexing rotates, and a second fitment is advanced into attaching position.

11 Claims, 3 Drawing Sheets

APPARATUS AND PROCESS FOR POSITIONING A FITMENT

FIELD OF THE INVENTION

This invention relates to an apparatus and process for positioning and attaching a plurality of fitments to a film. More particularly, the invention relates to such apparatus and process for use in a form/fill/seal process.

BACKGROUND OF THE INVENTION

In the field of packaging food and non-food liquid and/or flowable food and non-food products, a convenient method of packaging such products in thermoplastic film has been developed and is generally known as a form/fill/seal process. In such a process a tube is formed from thermoplastic film and the bottom end seal is made by transversely sealing across the tube with heated seal bars to form a conveniently wide heat seal and, consequently, producing a bag or pouch ready to receive a product. After the heat seal is made, the bag or pouch is filled and then another transverse heat seal is made across the width of the tube in a relatively wide band. After cooling, this seal is transversely severed to separate the filled bag from the next bag to be filled. Thus, one wide band seal serves as the bottom seal for one bag and the top seal for another.

Many horizontal and vertical form/fill/seal systems are commercially available from manufacturers or suppliers such as Hayssen, Omori, Ilapak, and Kartridge Pak.

One commercial system is supplied by W.R. Grace & Co.-Conn. through its Cryovac Division. This system is referred to as Onpack (TM) and is generally described in U.S. Pat. No. 4,506,494, incorporated herein by reference, which issued on Mar. 26, 1985 to Mamoru Shimoyama et al. In the Shimoyama et al. patent a vertically held tube with a bottom end that has been closed by a transverse heat seal is filled with a liquid, semiliquid, or paste charge or contents and squeeze rollers spaced apart and above the bottom end seal squeeze the filled tube and pinch the walls of the flatted tube together. When a length of tubing of the desired height of the bag has been fed through the squeeze rollers a heat seal is made transversely across the flattened tubing by heat seal bars which clamp and seal the film of the tube therebetween. After the seal bars have been withdrawn the film moves downwardly to be contacted by cooled clamping and severing bars which clamp the film therebetween and are provided with a cutting knife to sever the sealed film at about the midpoint of the seal so that approximately half of the seal will be on the upper part of a tube and the other half on the lower. When the sealing and severing operation is complete, the squeeze rollers are separated to allow a new charge of product to enter the flattened tube after which the aforementioned described process is repeated thus continuously producing vertical form/fill/seal pouchs which have a bottom end and top end heat seal closure.

U.S. Pat. No. 4,603,793 (Stern), incorporated herein by reference in its entirety, discloses a coupling means 6a which is mounted on the inside wall of a pouch. Such coupling means, or fitments, offer several advantages in packaging food products, such as the capability of connecting the fitment to a pumping device. This permits the contents of the package to be dispensed in a controllable way. The particular coupling device described in U.S. Pat. No. 4,603,793 is mounted inside the pouch. This arrangement avoids the disadvantages associated with externally mounted fitments. These include the difficulty of properly packing multiple pouch units, and the possibility that an external fitment will be damaged during handling/storage. If this happens, the food or other pouch contents can possibly leak out.

Packaging systems combining the Onpack (TM) system with the fitment technology of U.S. Pat. No. 4,603,793 have proven effective in providing a pouch making system where the pouch, containing a food product, includes an internal fitment.

One of the requirements of using fitments of this general type is that they be accurately indexed and positioned to ensure that each fitment in a series of fitments is attached squarely to the film or pouch material at the appropriate location, for example by heat sealing the film to the fitment. If the fitments are not positioned accurately and consistently, they may not attach properly, and the resulting pouch or other container made from the film can possibly leak at the point where the fitment is joined to the film. In addition, inconsistent placement of the fitments with respect to the means for attaching (e.g. heat sealing means) and film can result in inconsistent attachment of a series of fitments on respective containers made from the film. Thus, for example, from pouch to pouch in a production run, the fitment on a given pouch may be located at a slightly different relative location on the pouch than another fitment on another successive pouch in the series. The present invention offers an improved apparatus and process for positioning and attaching fitments to a film, bag or pouch, especially in a form/fill/seal packaging system.

SUMMARY OF THE INVENTION

In one aspect of the present invention, an apparatus for positioning and attaching a plurality of fitments to a film comprises a means for guiding a plurality of fitments; a means for attaching the fitments to the film; and a means for indexing the fitments, the means for indexing comprising a plurality of projecting fingers thereon, the projecting fingers being spaced apart from each other at respective outer ends of each finger, such that when a first fitment has been attached to the film and advances past the means for indexing, the means for indexing rotates, and a second fitment is advanced into attaching position.

In another aspect of the invention, a process for positioning and attaching a plurality of fitments to a film comprises engaging a first fitment with a means for indexing having a plurality of projecting fingers thereon, the projecting fingers being spaced apart from each other at respective outer ends of each finger; attaching the first fitment to the film; and advancing the film, with the first fitment attached thereto, such that the first fitment advances past the means for indexing, the means for indexing rotates, and a second fitment is advanced into attaching position.

BRIEF DESCRIPTION OF THE DRAWINGS

The invention may be further understood by reference to the drawings attached hereto, in which.

DESCRIPTION OF THE PREFERRED EMBODIMENT

Figure 1:
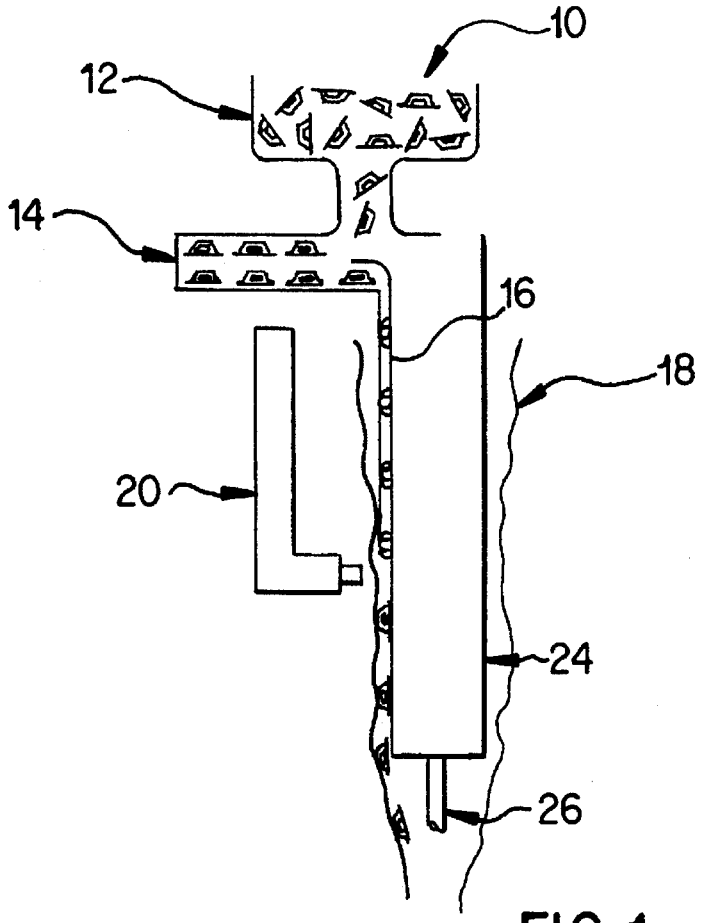
FIG. 1 represents a schematic elevational view of a conventional apparatus and method of positioning and attaching a plurality of fitments to a tubular film in a vertical form/fill/seal system, some of the fitments positioned in a track.
Figure 2:
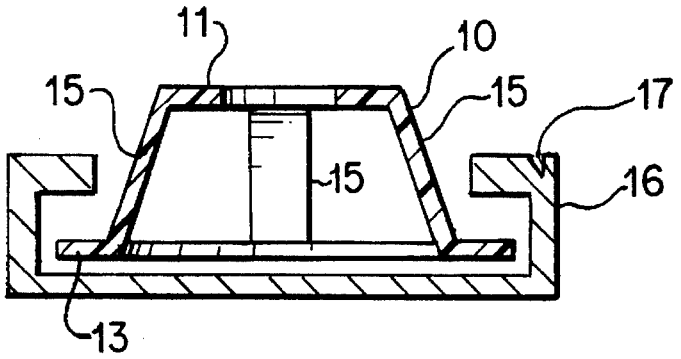
FIG. 2 shows a cross section of a fitment in a track.

Referring to FIG. 1, the vertical form/fill/seal (VFFS) apparatus and process of the present invention will be described as a preferred embodiment. VFFS technology is generally well known, and conventional details of such systems need not be discussed in detail. A preferred VFFS system for use with the present invention is the Onpack Model 2000 equipment offered by W.R. Grace & Co.-Conn. through its Cryovac Division. Fitments 10 are put into a hopper 12. These fitments 12 are then run through an orienter 14 to align the fitments in an appropriate direction to move down by gravity along track 16. A cross-section of track 16 is shown in FIG. 2. Both the fitments 10 and track 16 can be of any suitable shape, size, and composition. A preferred fitment design is of the type shown in FIG. 2, and described in U.S. Pat. No. 4,603,793 (Stern) as a coupling means *6a*.

The track 16 is disposed along the side of mandrel 24, preferably within a groove or indentation (not shown) in the mandrel to accommodate the track.

Film 18, in the form of a sleeve, is drawn down the outside (exteriorly) of mandrel 24 and outside the track 16, but inside (interiorly) an attaching means, preferably a heat sealing means 20. Thus, in normal operation of the VFFS system, the film 18 passes between the attaching means and the fitments. When each fitment is indexed down to the appropriate position adjacent the film, the heat sealer is activated to press and seal the film to the fitment. After the fitment has been attached to the film, the film is advanced downwardly, where the filling process, transverse sealing, and final pouch making occurs by means well known in the art.

The fitment 10 of FIG. 2 includes a top ring 11 and a bottom ring 13 with respective orifices therein, and legs 15. The track 16 optionally includes a groove 17 into which set screws or the like may be placed. to attach appropriate mounting brackets for the indexing means, or the indexing means directly.

Figure 3:
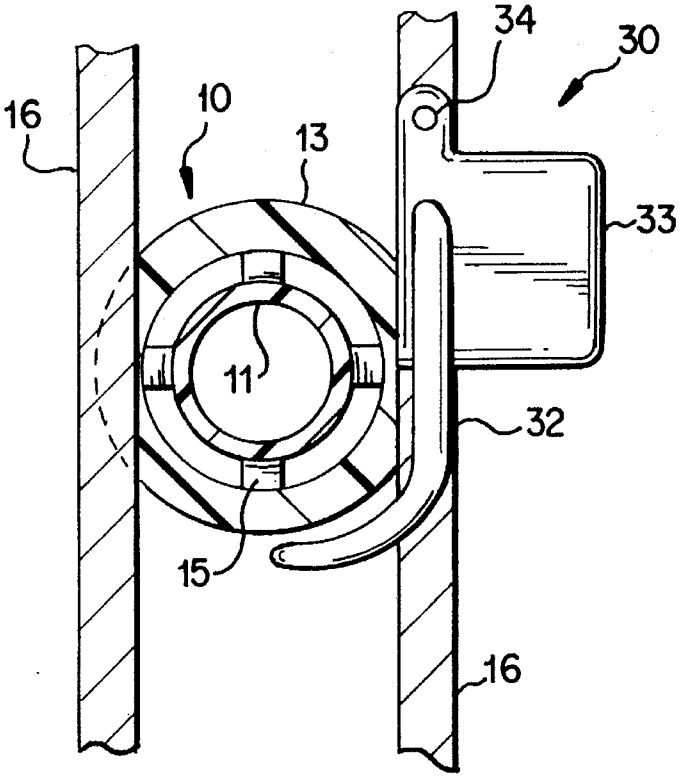
FIG. 3 shows a counterweight with a single finger, used in a conventional system, the counterweight shown in relation to a fitment located in a track.

In FIG. 3, a "J" shaped hook 32 is shown as part of a conventional indexing means 30, pivotable about a screw or other pivoting means 34. In a static position, the hook 32 is positioned as shown. After attachment of a fitment 10 to film 18, the film is advanced downwardly, of course bringing the attached fitment with it. The force exerted on the film, and therefore the fitment, pulls the attached fitment further down the track 16. This in turn forces the hook 32 down and away along pivot 34, allowing the next fitment to drop down into place. The indexing means 30 operates as a counterweight by means of body portion 33, swinging back into place for the next attaching cycle. The index means 30 will sometimes jam the next fitment against the far side of the track, so that the next fitment does not line up exactly like the first fitment. The inventor has noted variations of as much as 0.5 inches in fitment position.

Figure 4:
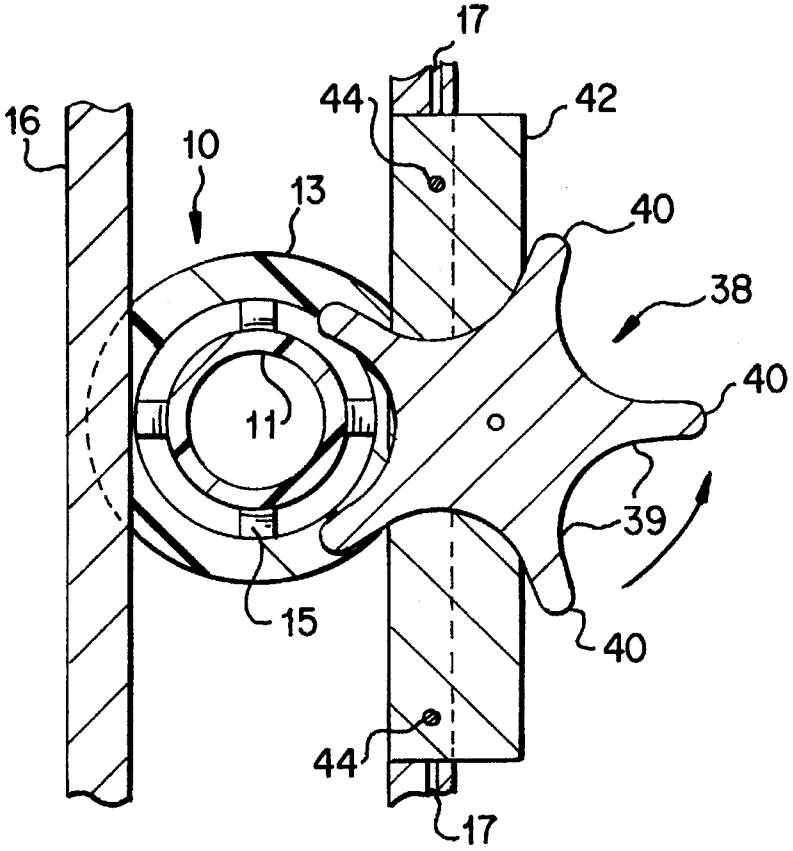
FIG. 4 shows an embodiment of an indexing means according to the invention, the indexing means shown in relation to a fitment located in a track.

The inventor has found that by using a plurality, i.e. two or more fingers on an indexing means, a reduction in the variability of fitment positioning can be achieved, down to as much as ⅛ inch. As shown in FIG. 4, an indexing means 38 is a multifingered wheel shaped like a star. This star wheel rotates intermittently in the direction indicated by the arrow, during operation of the VFFS system, to allow the advancement of an attached fitment and the controlled advance of a second fitment into attaching position. The fingers 39 having outer ends 40 act to control the advance of the next fitment in the series of fitments dropping down track 16. Star wheel 38 is shown mounted to a bracket 42, which is in turn mounted, for example by set screws 44, to track 16 in groove 17. In this way, the means for indexing can be adjusted up or down the track 16. Alternatively, star wheel 38 can be mounted directly to the track 16 or other suitable means for guiding the fitments, as long as the relative dimensions of the guiding, attaching, and indexing means allow for appropriate clearance of parts, and operation of the apparatus and process as herein described.

A spring washer (not shown) or other suitable braking means mounted beneath the star wheel 38 serves to brake the star wheel sufficiently such that the weight or force exerted on the wheel by fitments 10 in the track will not substantially rotate the wheel, but still allow the wheel to rotate during advancement of each fitment after attachment to the film.

Figure 5:
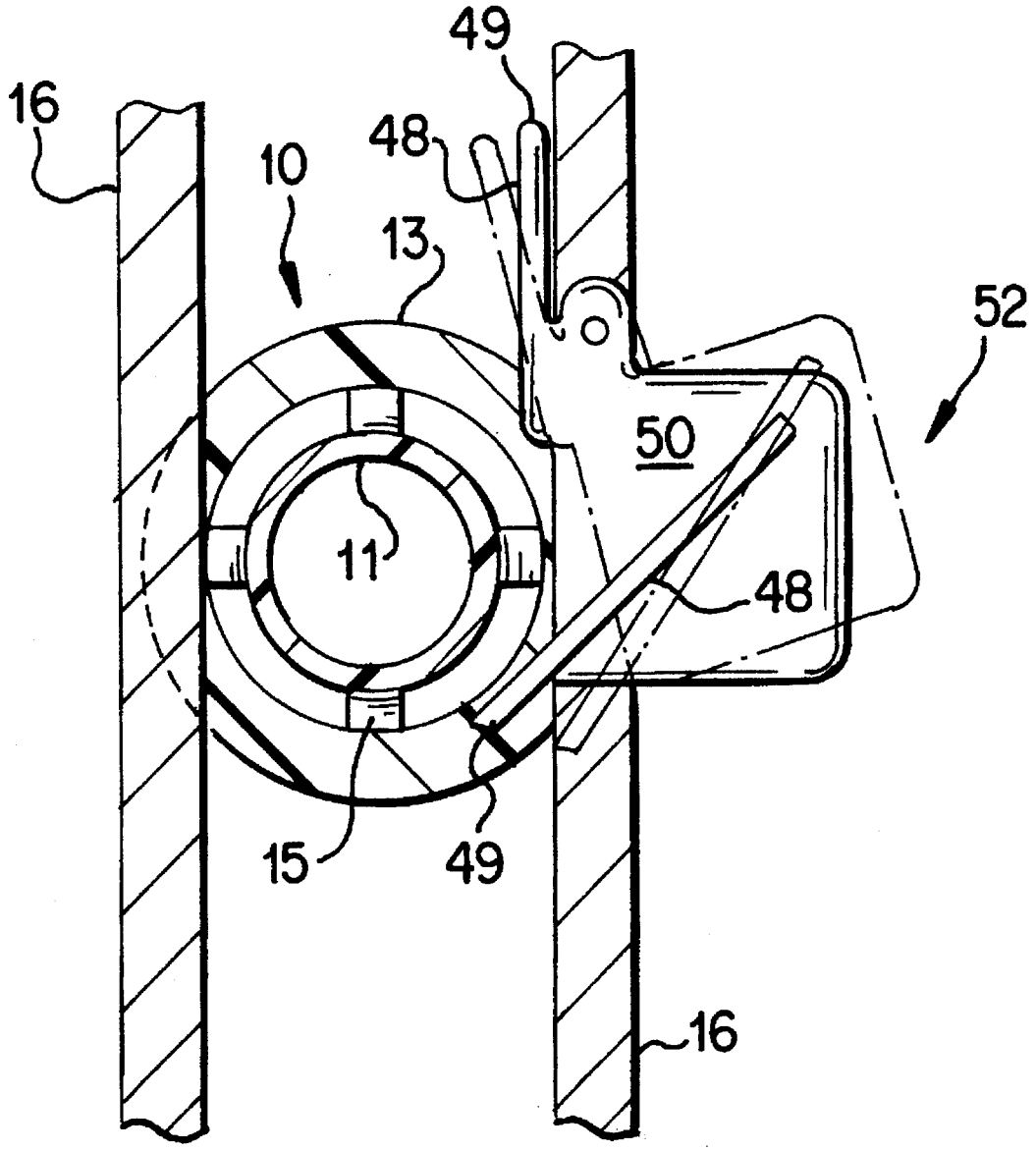
FIG. 5 shows an alternative embodiment of an indexing means according to the invention, the indexing means shown in two positions in relation to a fitment located in a track.

In an alternative embodiment (FIG. 5), a multifingered indexing means 52 includes fingers 48 having outer ends 49 and a body portion 50 acting as a counterweight. The lines in phantom show how the means 52 rotates away during advancement of the attached fitment, such that the top finger 48 prevents the next fitment (not shown for clarity) from dropping down until the means 52 has rotated back into position. The means 52 can be mounted on a suitable bracket (not shown) or can be mounted directly to the track 16 or other suitable means for guiding the fitments, as long as the relative dimensions of the guiding, attaching, and indexing means allow for appropriate clearance of parts, and operation of the apparatus and process as herein described.

The present invention provides a simple solution with relatively few moving parts. This is important, since the means are located inside a film tube wherein a food product could be placed.

It is to be understood that variations and modifications of the present invention may be made without departing from the scope of the invention. It is also understood that the scope of the invention is not to be interpreted as limited to the specific embodiments disclosed herein, but only in accordance with the appended claims when read in light of the foregoing disclosure. The detailed description of the preferred embodiment is given by way of illustration only since numerous changes and modifications well within the spirit and scope of the invention could become apparent to those already skilled in the art in view of the description herein. For example, although the means for attaching is described as a heat sealing means, other means, such as application of an adhesive, can be used. Although described with reference to VFFS technology, this invention can be adapted to other packaging systems. Films suitable for use in the present invention are well known, generally being polymeric thermoplastics.

What is claimed is:

1. An apparatus for positioning and attaching a plurality of fitments to a film, comprising:

a) a means for guiding a plurality of fitments;

b) a means for attaching the fitments to the film;

c) means for advancing the attached fitments and film; and d) a means for indexing the fitments driven by the film, the means for indexing the fitments comprising a counterweight having two projecting fingers thereon, the projecting fingers being spaced apart from each other at respective outer ends of each finger, said counterweight constructed such that when a first fitment has been attached to the film and advances past the means for indexing, the means for indexing rotates, and a second fitment is advanced into attaching position and said indexing means rotates back to its original position.

2. The apparatus of claim 1 wherein the apparatus forms part of a vertical form/fill/seal system.

3. The apparatus of claim 1 wherein the means for guiding a plurality of fitments comprises a track.

4. The apparatus of claim 1 wherein the means for attaching the fitments to the film comprises a means for heat sealing the fitments to the film.

5. A process for positioning and attaching a plurality of fitments to a film, comprising:

a) engaging a first fitment with a means for indexing the fitments, the means for indexing the fitments driven by movement of the film and comprising a counterweight having two projecting fingers thereon, the projecting fingers being spaced apart from each other at respective outer ends of each finger;

b) attaching the first fitment to the film; and c) advancing the film, with the first fitment attached thereto, such that as the first fitment advances past the means for indexing, the means for indexing rotates from a first position to a second position, and as a second fitment is advanced into attaching position, the means for indexing rotates back to the first position.

6. The process of claim 5 wherein the process for positioning and attaching a plurality of fitments to a film forms part of a vertical form/fill/seal process.

7. The process of claim 5 wherein the process for positioning and attaching a plurality of fitments to a film further comprises, prior to step (a), advancing a plurality of fitments to a means for attaching the fitments to the film.

8. The process of claim 5 wherein the step of attaching the first fitment to the film comprises heat sealing the first fitment to the film.

9. The process of claim 5 wherein the first fitment is advanced by advancing the film to which the first fitment is attached.

10. An apparatus for positioning and attaching a plurality of fitments to a film, comprising:

a) a means for guiding a plurality of fitments;

b) a means for attaching the fitments to the film;

c) means for advancing the attached fitments and film;

d) a means for indexing the fitments, the means for indexing the fitments comprising a wheel driven by movement of the film and having a plurality of projecting fingers thereon which are equally spaced apart from each other at respective outer ends of each finger, such that as each of the fitments is attached to the film and advances past the means for indexing, the means for indexing rotates intermittently in the same direction, and a subsequent fitment is advanced into attaching position; and e) means for braking the wheel sufficiently that the weight or force exerted on the wheel by the fitments will not substantially rotate the wheel, but still allow the wheel to rotate during advancement of each fitment after attachment to the film.

11. A process for positioning and attaching a plurality of fitments to a film, comprising:

a) engaging each fitment with a means for indexing the fitment, the means for indexing each fitment comprising a wheel driven by movement of the film and having a plurality of projecting fingers thereon which are equally spaced apart from each other at respective outer ends of each finger, the projecting fingers being spaced apart from each other at respective outer ends of each finger;

b) attaching each fitment to the film;

c) advancing the film, with each fitment attached thereto, such that as each of the fitments is attached to the film and advances past the means for indexing, the means for indexing rotates intermittently in the same direction, and a subsequent fitment is advanced into attaching position; and d) braking the wheel sufficiently that the weight or force exerted on the wheel by the fitments will not substantially rotate the wheel, but still allow the wheel to rotate during advancement of each fitment after attachment to the film.

* * * * *